United States Patent [19]

Williams

[11] 4,023,330

[45] May 17, 1977

[54] WRAPPING MACHINES

[75] Inventor: John W. Williams, Jacksonville, Fla.

[73] Assignee: Terminal Paper Bag Co., Yulee, Fla.

[22] Filed: Nov. 21, 1975

[21] Appl. No.: 634,171

[52] U.S. Cl. ..... 53/378

[51] Int. Cl.[2] ..... B65B 49/14; B65B 49/08; B65B 11/12

[58] Field of Search ..... 53/378, 379, 210, 226, 53/371, 383, 32, 38

[56] References Cited

UNITED STATES PATENTS

| | | | |
|---|---|---|---|
| 1,539,400 | 5/1925 | Neusbaum | 53/379 |
| 2,407,313 | 9/1946 | Malhiot | 53/379 X |
| 2,584,529 | 2/1952 | Allen | 53/378 |
| 2,940,236 | 6/1960 | Conti | 53/379 |
| 3,411,268 | 11/1968 | Long | 53/371 |

*Primary Examiner*—Othell M. Simpson
*Assistant Examiner*—Horace M. Culver
*Attorney, Agent, or Firm*—Edwin T. Grimes

[57] ABSTRACT

The present invention relates to method and apparatus for forming bundles of articles wrapped in a tubular wrapper including an upper panel having an upper flap at each end thereof, a bottom panel having a bottom flap at each end thereof, and a pair of opposed side panels, each having a side flap at the end thereof, and apparatus for forming an end closure at each end of the bundle, which includes a pair of folding wings for forming corner fold lines between the bottom flaps and their adjacent side flaps respectively, the fold lines at the time of their formation extending substantially parallel to the bottom panel, the folding wings also folding a portion of the side flaps inwardly, a folding shoe for folding the bottom flap inwardly to partially cover the side flaps, an adhesive nozzle for forming a line of adhesive extending across the bottom flap and partially across each of the side flaps, an upper flap forming shoe for completing the inward folding of the side flaps and for folding the upper flaps inwardly to engage the line of adhesive to seal the bundle; in another form of the invention each of the upper flap forming shoes includes a downwardly-forwardly angled inlet portion, a horizontal portion and a vertically disposed sidewall portion.

6 Claims, 18 Drawing Figures

WRAPPING MACHINES

This invention relates to wrapping machines and more particularly to the formation of a bundle comprising articles disposed in a tubular wrapper having at each end a top flap, a bottom flap and a pair of opposed side flaps. The machine according to my invention is particularly useful for wrapping commercial articles or packages such as paper bags, for example.

While successful wrapping machines have been employed heretofore, such as the one described in U.S. Pat. No. 3,492,781, issued to Pat Everett Ray, for example, my contribution to the art is in the nature of improvements with respect to certain aspects of the aforementioned prior art wrapping machines.

The invention has as one of its objectives, the provision of new and improved components of a wrapping machine, which forms a package having a substantially increased adhesive area, thereby providing a stronger finished package, and having accurately disposed fold lines and flap portions, thereby providing neat and aesthetic appearing end closures.

The invention provides as another of its objectives, a machine of the character aforesaid, which has new and improved side flap folding means, which has new and improved upper flap folding means, and which operates continuously and accurately at high rates of speed.

Further, as still another objective thereof, the invention provides new and improved components of a wrapping machine, which may be adapted for use with present machinery without substantial alterations thereto.

These and other advantages of the method and apparatus of the invention, as compared to wrapping apparatus heretofore utilized for the above stated purposes, will become apparent as the discussion proceeds.

Briefly, my invention contemplates, in a machine of the class described for forming bundles of articles wrapped in a tubular wrapper characterized by an upper panel having an upper flap at each end thereof, a bottom panel having a bottom flap at each end thereof, and a pair of opposed side panels, each having a side flap at the ends thereof, the combination comprising means for forming an enclosure at each end of the bundle. The means for forming the end closure includes means, preferably a pair of folding wings, for forming corner fold lines between the bottom flaps and their adjacent side flaps, respectively. The fold lines at the time of their formation extend substantially parallel to the bottom panel. The folding wings for forming the corner fold lines also fold a portion of the side flaps inwardly. The combination further includes means for folding the bottom flap upwardly to partially cover the side flaps, and means for applying a line of adhesive extending across the bottom flap and partially across each of the side flaps. Further, the combination includes means for completing the inward folding of the side flaps and for folding the upper flap inwardly to engage the line of adhesive to seal the bundle.

According to one aspect of the invention, the folding wings for forming the corner fold lines between the bottom flaps and their adjacent side flaps respectively, each comprise a pair of folding wings movable between an open position and a closed position wherein the fold lines are formed therebetween. The folding wings are hingedly connected together by hinge means and are mounted so that in their open position they are substantially parallel to the side panels and in their closed position they are substantially parallel to the bottom panel. The width of each folding wing, adjacent the side of the bundle, is preselected so that the length of the end edge of the bottom flap is substantially less than the length of the end edge of the upper flap, thereby providing a line of adhesion to adhere the top flat not only to the bottom flap but also to portions of the side flaps.

According to another aspect of the invention, the means for completing the inward folding of the side flaps and for folding the upper flap downwardly to engage the line of adhesion includes, at each end of the bundle, an upper flap forming shoe having a downwardly-forwardly angled inlet portion, a horizontal portion and a vertically disposed sidewall portion. The inlet portion is plate-like and it is wider than the horizontal portion, and it is connected to the vertical portion along a downwardly-forwardly directed line.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the design of other structures and methods for carrying out the several purposes of the invention. It is important, therefore, that this disclosure be regarded as including such equivalent constructions and methods as do not depart from the spirit and scope of the invention.

One embodiment of the invention has been chosen for purposes of illustration and description, and is shown in the accompanying drawings, forming a part of the specification, wherein.

Figure 1:
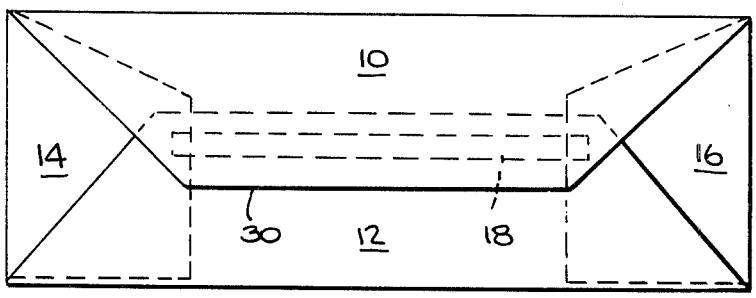
FIG. 1 is a plan view of one end of a finished, sealed bundle, according to the prior art.

In the illustrated embodiment of my invention, the bag baling machine may be of any conventional type, such as the one described in U.S. Pat. No. 3,492,781, wherein the machine receives a stack of bags encompassed in a wrapping of tubular shape. As the bundle passes through the machine a series of operations are performed thereon to completely encompass and secure the stack of bags. This invention is particularly directed to new and improved end closure means for the bundle. Heretofore, the end closures, as seen in FIG. 1, included an upper flap 10, a bottom flap 12 and a pair of opposed side flaps 14 and 16. The upper flap 10 was secured to the bottom flap 12 by means of an adhesive line 18.

Figure 2:
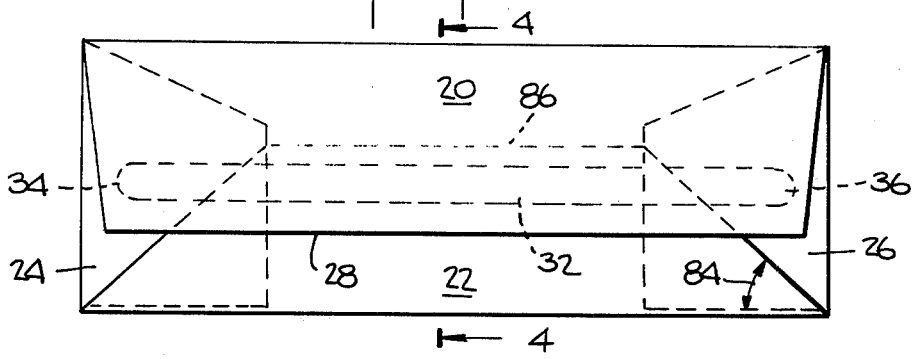
PRIOR ART Fig. 2.
FIG. 2 is a plan view of one end of a finished, sealed bundle, according to the present invention.

As distinguished from the end closure of the prior art, as seen in FIG. 1, the end closure according to the concepts of the present invention is shown in FIG. 2, which comprises an upper flap 20, a bottom flap 22 and a pair of opposed side flaps 24 and 26. It should be particularly appreciated that the upper flap, according to the present invention, has a substantially longer end edge 28 as compared to the end edge 30 of the prior art construction, and the end edge 86 of the bottom flap 22 is substantially shorter than the end edge of the bottom flap 12 of the prior art. As a result, the adhesive line 32 of the present invention is substantially longer than the adhesive line 18 of the prior art. Further, the adhesive line not only extends across the bottom flap, but also extends partially across the side flaps 24 and 26, as at 34 and 38, respectively, thereby providing a substantially stronger and neater package.

Figure 3:
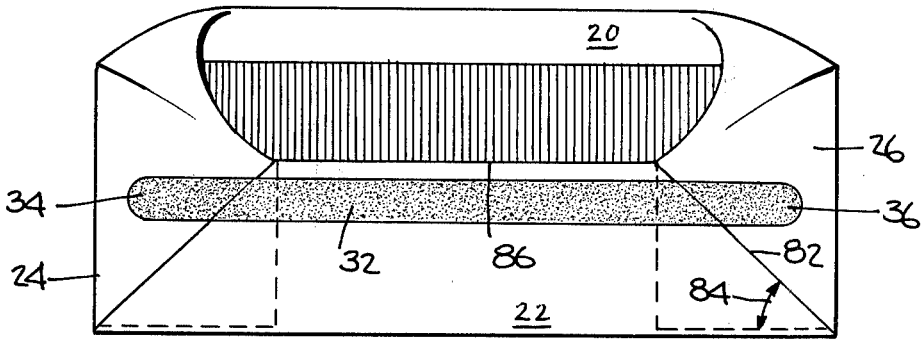
FIG. 3 is a plan view of one end of the bundle of FIG. 2, prior to the sealing thereof.

FIG. 3 shows the end closure of FIG. 2, but at a point in time prior to the folding over and sealing of the upper flap. This view more clearly shows the substantial length of the adhesive line 32.

Figure 4:
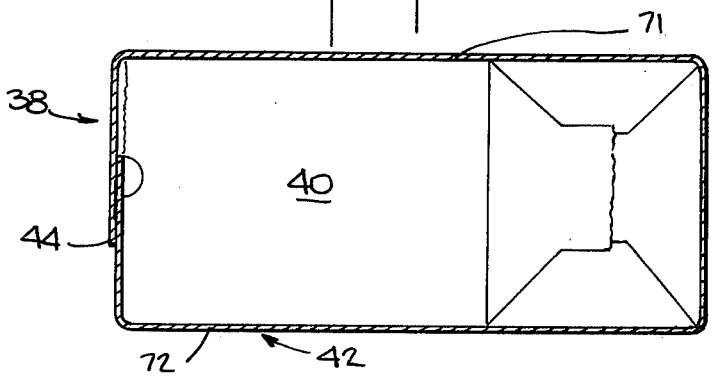
FIG. 4 is a transverse sectional view of the bundle of FIG. 2.

FIG. 4 is a transverse sectional view of the bundle indicated generally at 38, which includes a stack of bags 40 encompassed by a tubular wrapper indicated at 42, having a longitudinally extending seam 44, forming an upper panel 71, a bottom panel 72 and two side panels 73.

Figure 5:
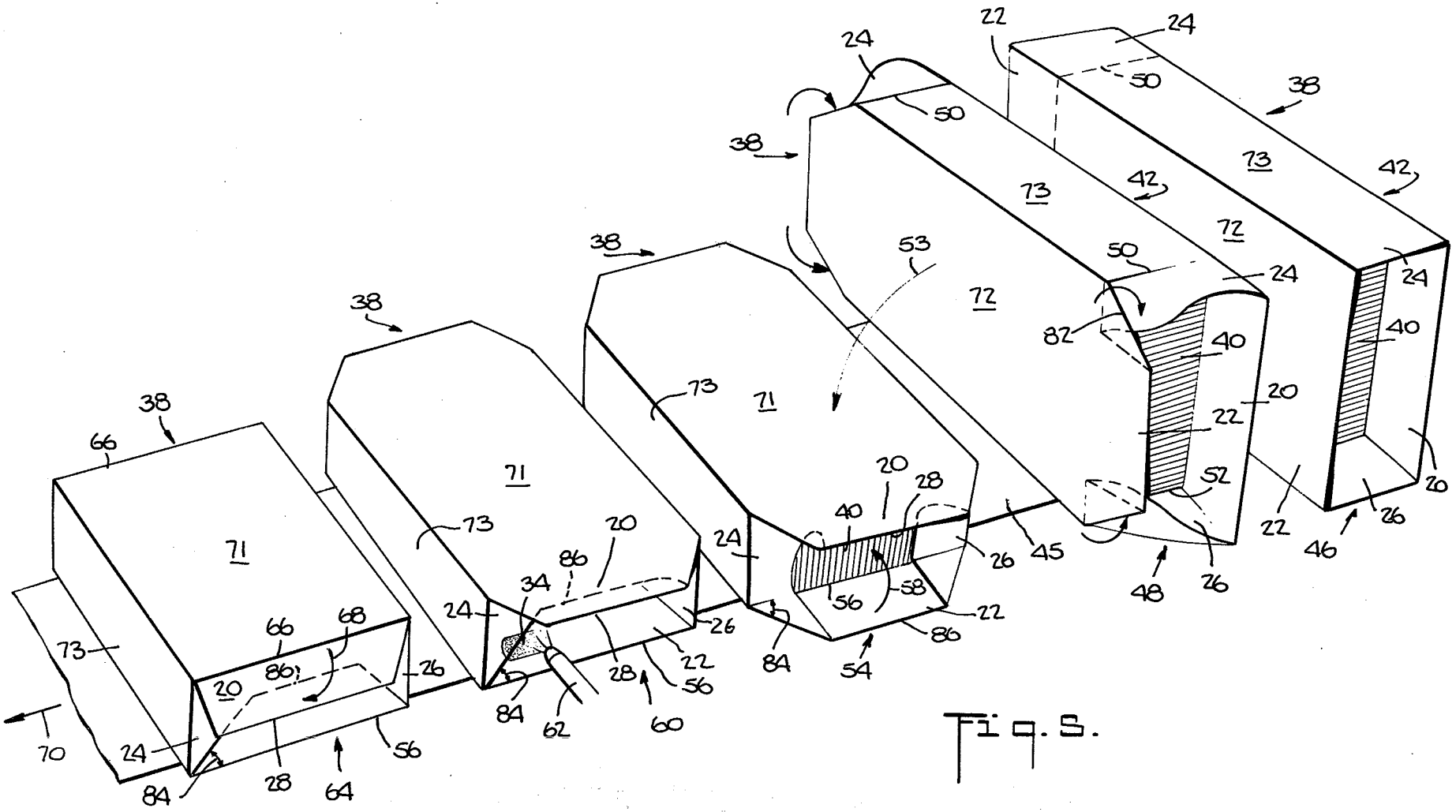
FIG. 5 is a perspective view showing the sequential formation of the end closure of the bundle according to the invention.

FIG. 5 shows a sequential series of steps or stages employed for forming the end closures of the bundles, as the bundle passes on a conveyor belt 45. As indicated at 46, the bundle is received with the stack of bags 40 encompassed in the tubular wrapper 42 while the end flaps extend substantially straight, outwardly.

The bundle 38 is then passed to a station, as indicated at 48, wherein the opposed side flaps 24 and 26 at both ends of the bundle are folded inwardly along their respective fold lines 50 and 52. The method and apparatus for effecting this folding step is an important feature of this invention, as will be pointed out more fully hereinafter.

The next step in the formation of the end closure is the rotation of the bundle 90°, as indicated by the arrow 53, onto the conveyor belt 45 whereon it is carried to the station indicated at 54. At this station, the bottom flap 42 is folded upwardly along its fold line 56, as indicated by the arrow 58, at each end of the bundle. Thereafter, the bundle 38 is passed to the station, indicated at 60, wherein an adhesive nozzle 62 forms an adhesive line 34 on the bottom flap 22 and partially across the side flaps 24 and 26. Finally, the bundle 38 is passed to the station, indicated at 64, wherein the upper flap 20 is folded downwardly along its fold line 66, as indicated by the arrow 68 to complete the end closure of both ends of the package. Thereafter, the completed bundle is discharged as indicated by the arrow 70.

Figure 6:
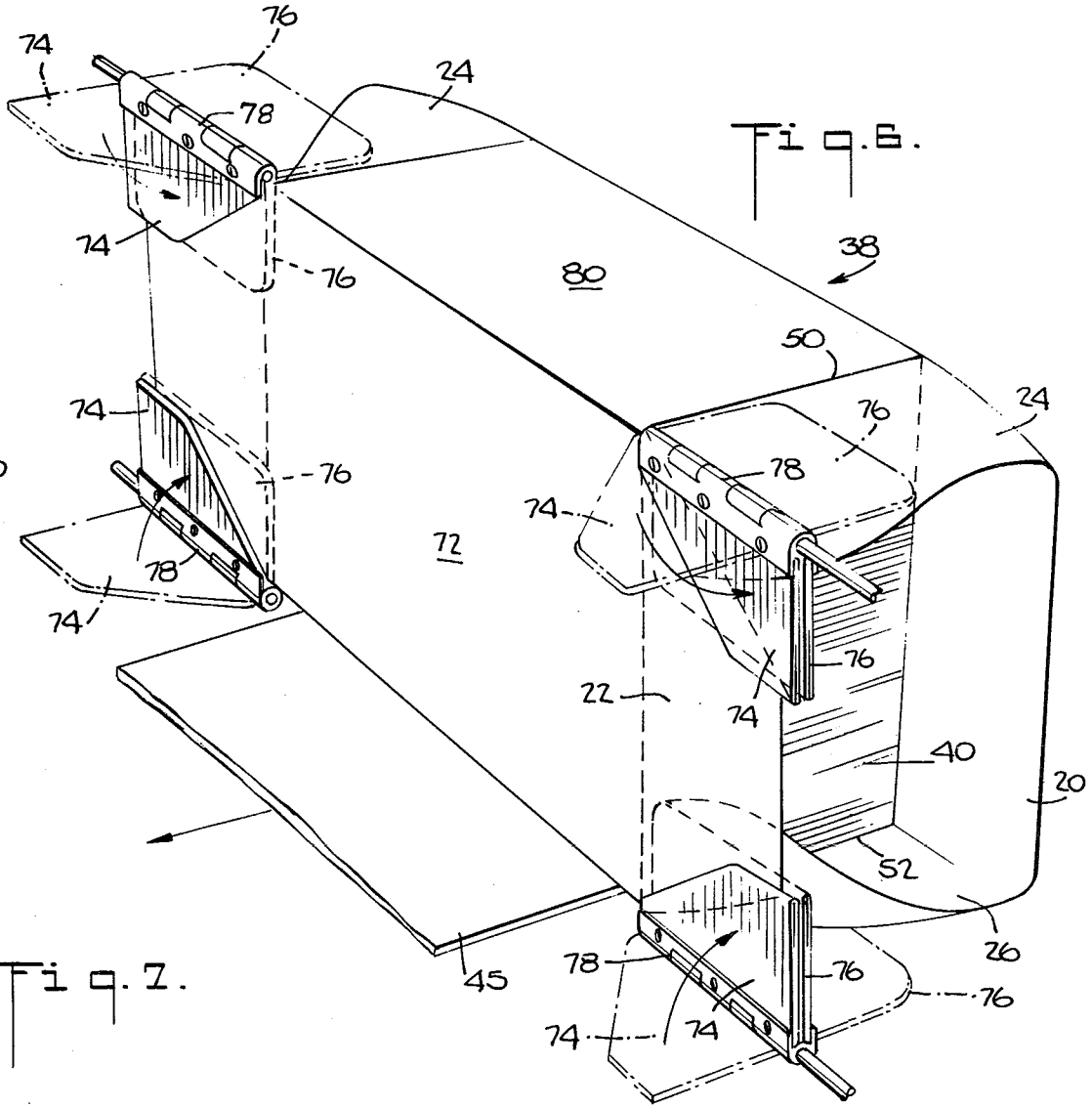
FIG. 6 is an enlarged perspective view showing the operation of the folding wings for forming the corner folds.
Figure 7:
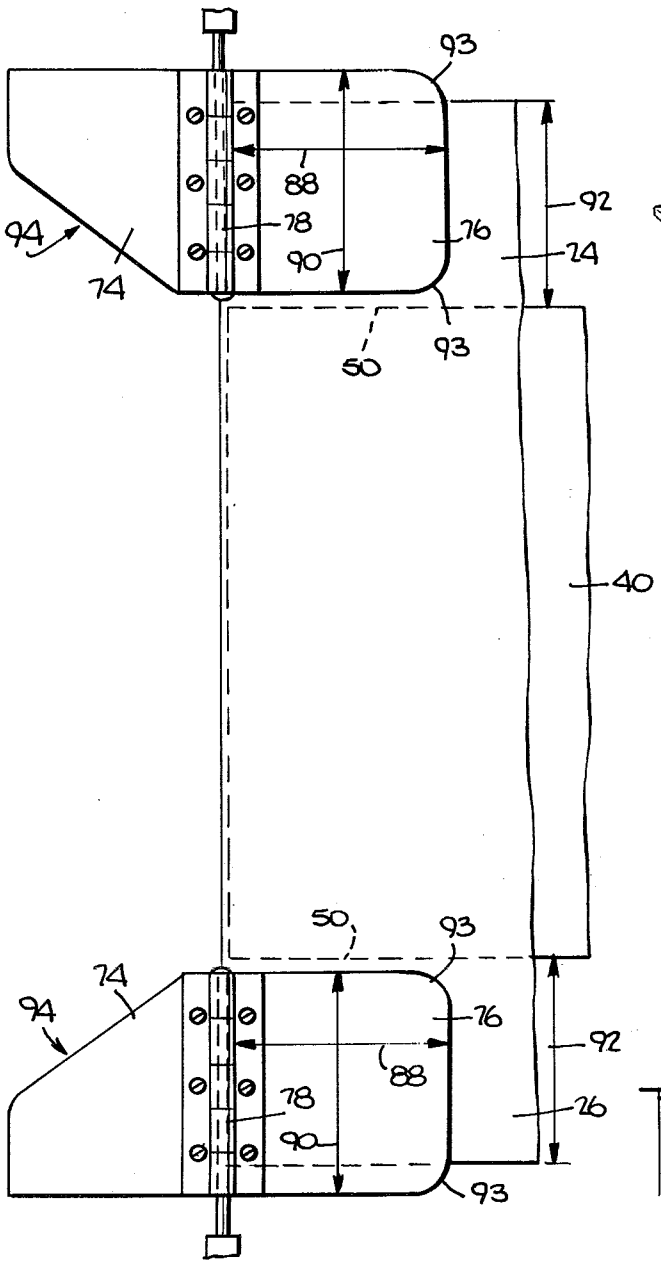
FIG. 7 is an enlarged side elevational view showing additional details of the folding wings.
Figure 8:
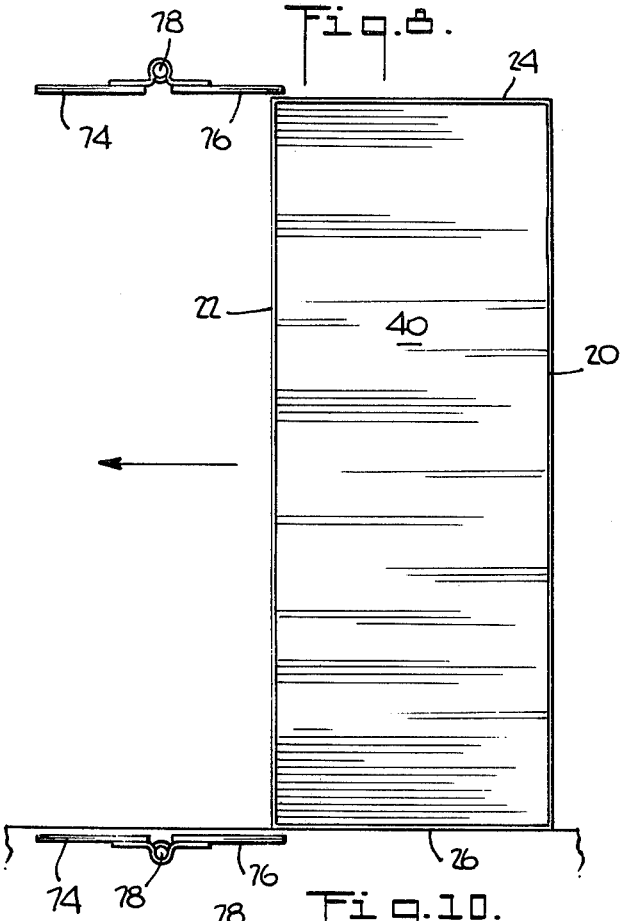
FIG. 8 is a plan view showing the bundle approaching the side flap folding station of the wrapping machine.
Figure 9:
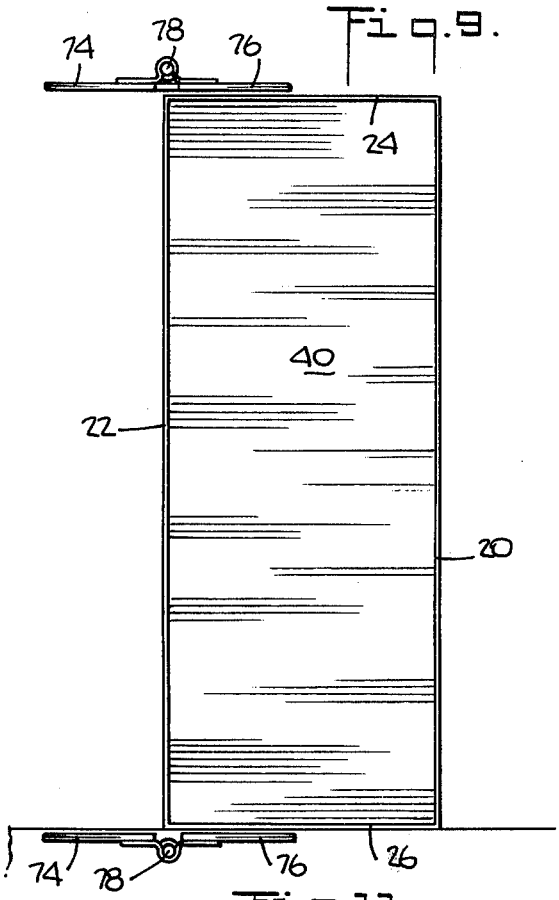
FIG. 9 is a plan view similar to FIG. 8, but showing the bundle after it has arrived in the side flap folding station.
Figure 10:
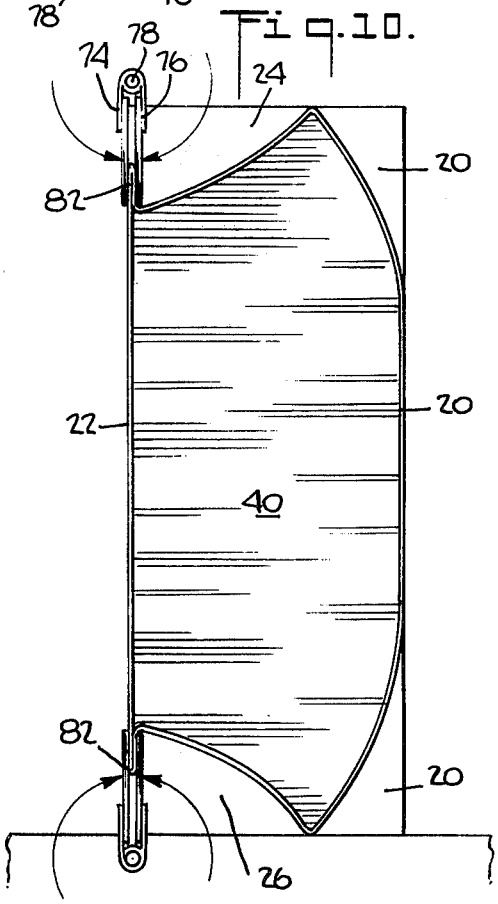
FIG. 10 is a plan view similar to FIG. 9, but showing the folding wings in their closed position.

FIGS. 6 to 11, show details of the method and apparatus for folding the side flaps 24 and 26, at the folding station indicated at 48 in FIG. 5. In this station the bundle is temporarily stopped during the folding operation. Adjacent each of the corners of the bottom panel 72 of the bundle 38, there is provided a pair of folding wings 74 and 76, which are hingedly connected together by hinge means 78. As best seen in FIG. 8, initially as the bundle approaches this station, the wings are in their open position wherein they are substantially parallel to the side panels 80 of the bundle. When the bottom panel 72 reaches the hinge means 78, as shown in FIGS. 7 and 9, the movement of the bundle is stopped. Thence, the folding wings are rapidly moved to their closed position as seen in FIG. 10. That is, the wings are rotated from their open position, as indicated by the broken lines in FIG. 6, to their closed position as indicated by the solid lines in the same figure. Any suitable motivating force may be employed to actuate the folding wings, such as a fluid piston assembly or other mechanical means, as desired. However, such movement must be effected rapidly and in closely timed relationship with the other operative components of the machine.

Figure 11:
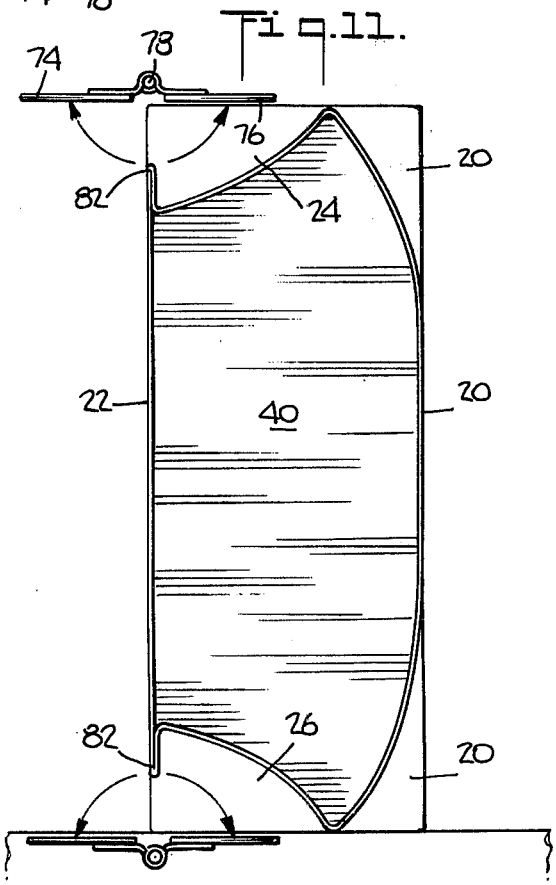
FIG. 11 is a plan view similar to FIG. 10, but showing the folding wings after they have returned to their original open position.

Still referring to FIGS. 6 and 10, the folding wings, when in their closed position, extend substantially parallel to the bottom panel 72, and form a sharp corner fold line 82, which also at this time extends substantially in the plan of the bottom panel 72, as seen in FIG. 10. This movement also folds a portion of the side flaps 24 and 26 along their fold lines 50 and 52, as seen in FIG. 2 and in FIG. 5 at station 48. In addition, the upper flap 20 is broken inwardly slightly at the corners thereof, as best seen in FIG. 10. It will be appreciated that the angle 84, as seen in FIGS. 2, 3 and 5, of the fold line 82, with respect to the bottom flap fold line 56, is of particular significance because this angle determines the length of the end edge 86 of the bottom flap. A decrease in the length of the end edge 86 of the bottom flap causes a corresponding increase in the length of the end edge 28 of the upper flap 20. The angle 84 between the fold line 82 and the bottom flap fold line 56 is determined by the selection of the width 88, FIG. 7, of the folding wing 76. An increase in the width 88 decreases the angle 84, thereby making the end edge 86 of the bottom flap shorter and the end edge 28 of the upper flap longer. Thus, according to the invention, the width 88 of the folding wing must be so selected that the end edge 28 of the last folding flap, i.e. the top flap 20 in the illustrated embodiment, is longer than the end edge 86 of its opposite flap, i.e. the bottom flap 22 in the illustrated embodiment. The length 90, FIG. 7, of the folding wing 76 should be slightly greater than the height 92 of the flaps. The corners 93 of this folding wing are preferably round as seen in FIG. 7. The dimensions of the folding wing 74 are not critical, but preferably the height and width thereof are substantially the same as the height and width of the folding wing 76, but having a corner recess thereof as indicated at 94 in FIG. 7. Thereafter, as seen in FIG. 11, the folding wings 74 and 76 are returned to their normal or open positions. Any suitable means may be employed for effecting the return movement of the folding wings, such as a spring member or other fluid or mechanical means, as desired.

Figure 12:
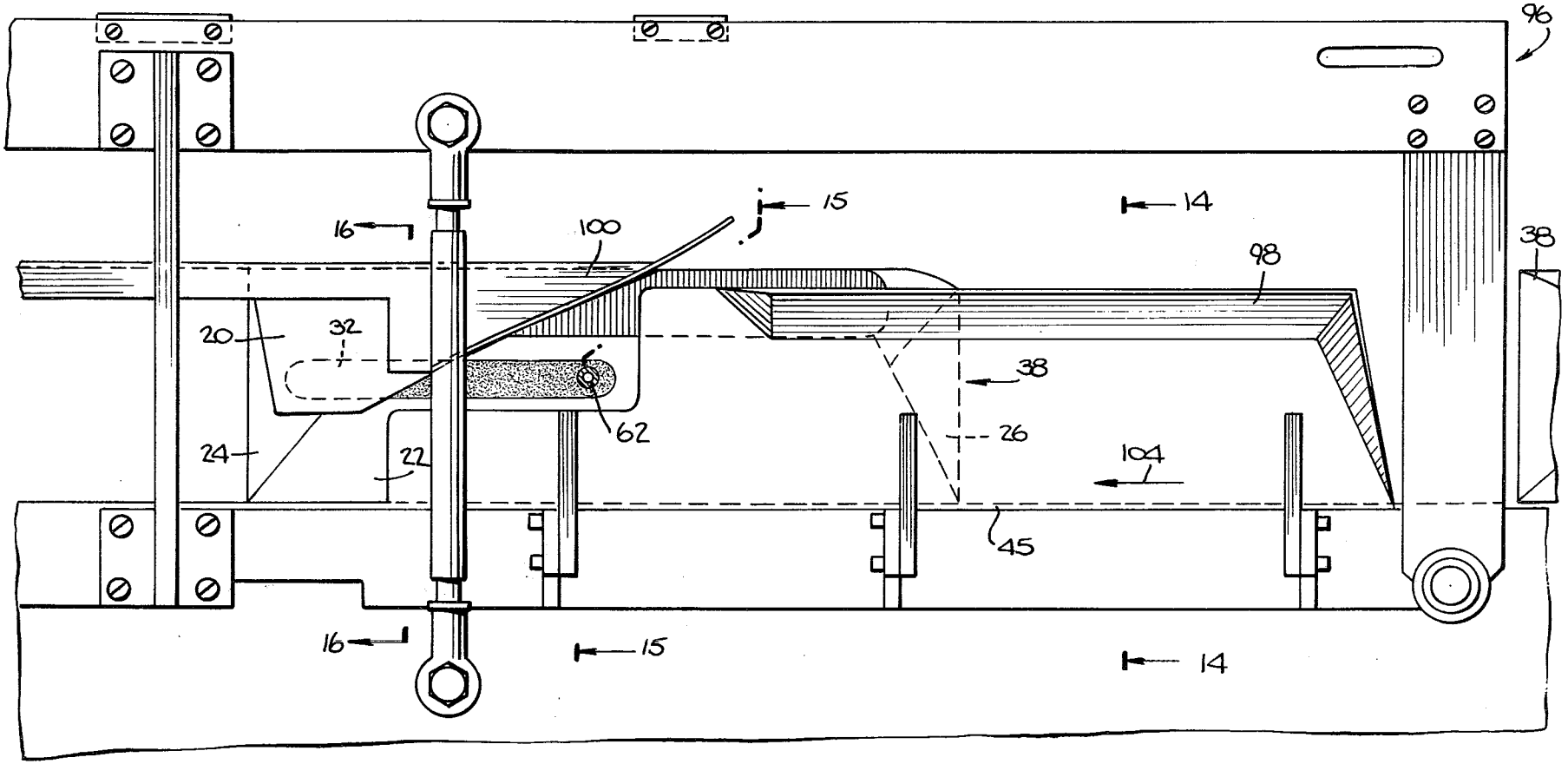
FIG. 12 is a side elevation of a portion of the wrapping machine showing the details of the folding shoes for folding the upper and lower flaps.
Figure 13:
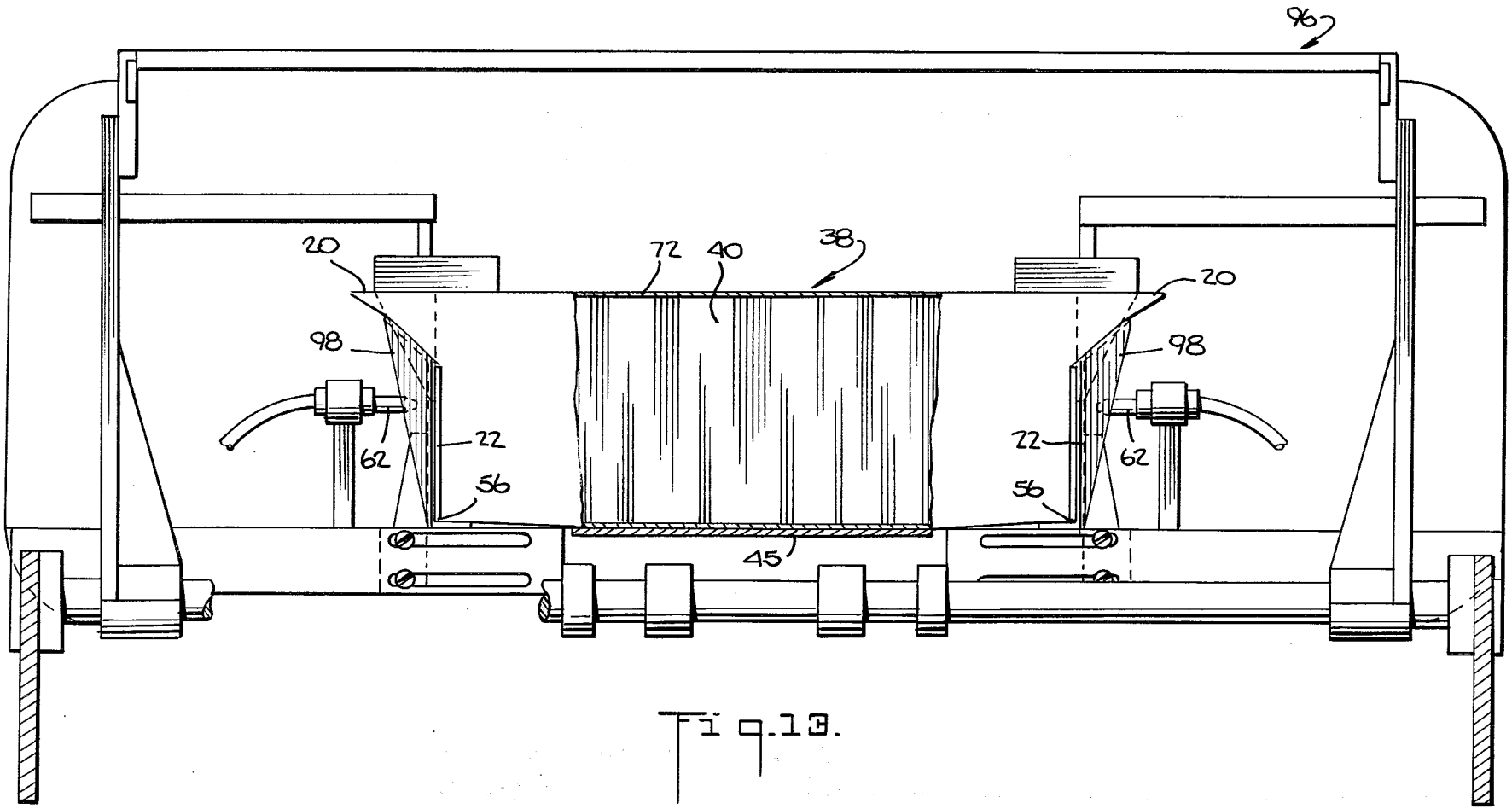
FIG. 13 is a transverse cross sectional view of the wrapping machine taken along the line indicated at 13—13 in FIG. 12, showing details of the bottom flap folding shoes.

Thence, the bundle is rotated 90° onto the conveyor belt 45, as indicated by the arrow 53, from the station 48 to the station 54, FIG. 5. FIG. 12 shows the portion of the machine encompassing stations 54, 60 and 64 of FIG. 5. A main frame assembly indicated generally at 96 fixedly supports a conventional bottom flap forming shoe 98, an upper flap forming shoe 100 and a conventional adhesive applying nozzle 62, for each end of the bundle. The conveyor belt 45 is adapted to pass through the main frame assembly in the direction of arrow 104 in order to carry the bundle 38 past the aforementioned elements. As seen in FIG. 13, the bottom flap forming shoe 98 has an upwardly-inwardly curved surface which engages the outside surface of the bottom flap and gradually folds it upwardly along its fold line 56, as the bundle 38 passes thereby on the conveyor belt 45.

Upon completion of this fold, the package has the appearance as shown at the station 60 in FIG. 5. At this point, in time, adhesive is sprayed from the nozzle 62 to form the adhesive line 34, which extends across the outside of the bottom flap and onto the side flaps as indicated at 34 and 36, in FIG. 3. The bundle is now ready for its final folding to complete the wrapping operation, as indicated at station 64 in FIG. 5.

Figure 17:
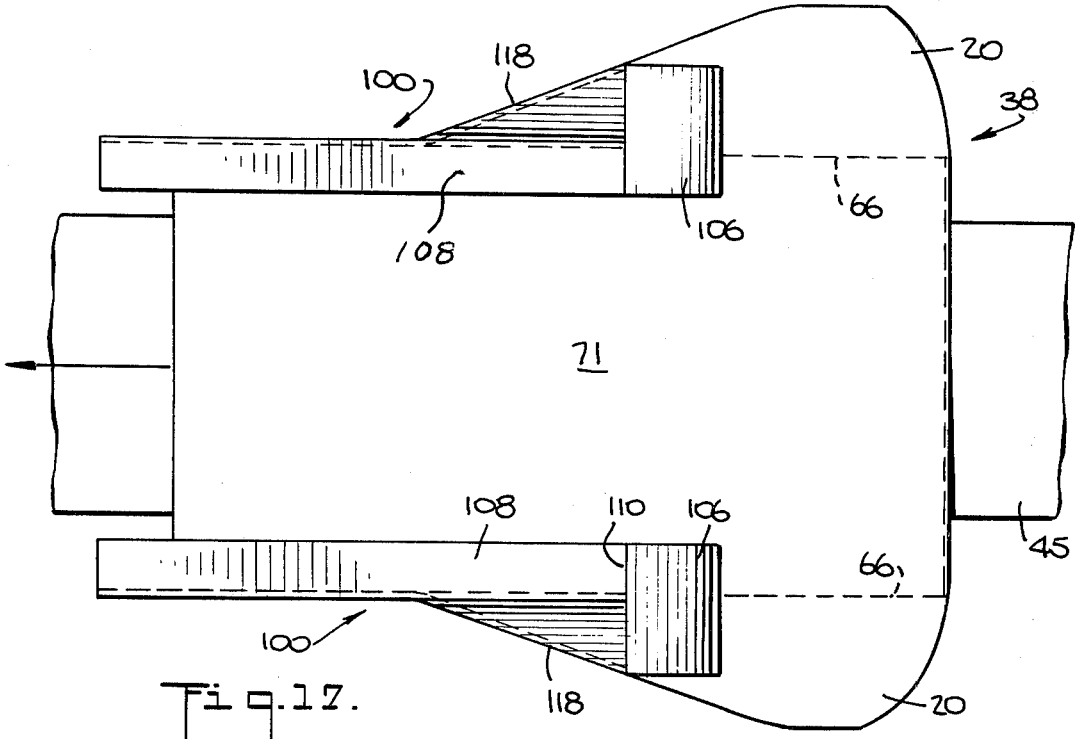
FIG. 17 is an enlarged plan view of the upper flap folding shoe.
Figure 18:
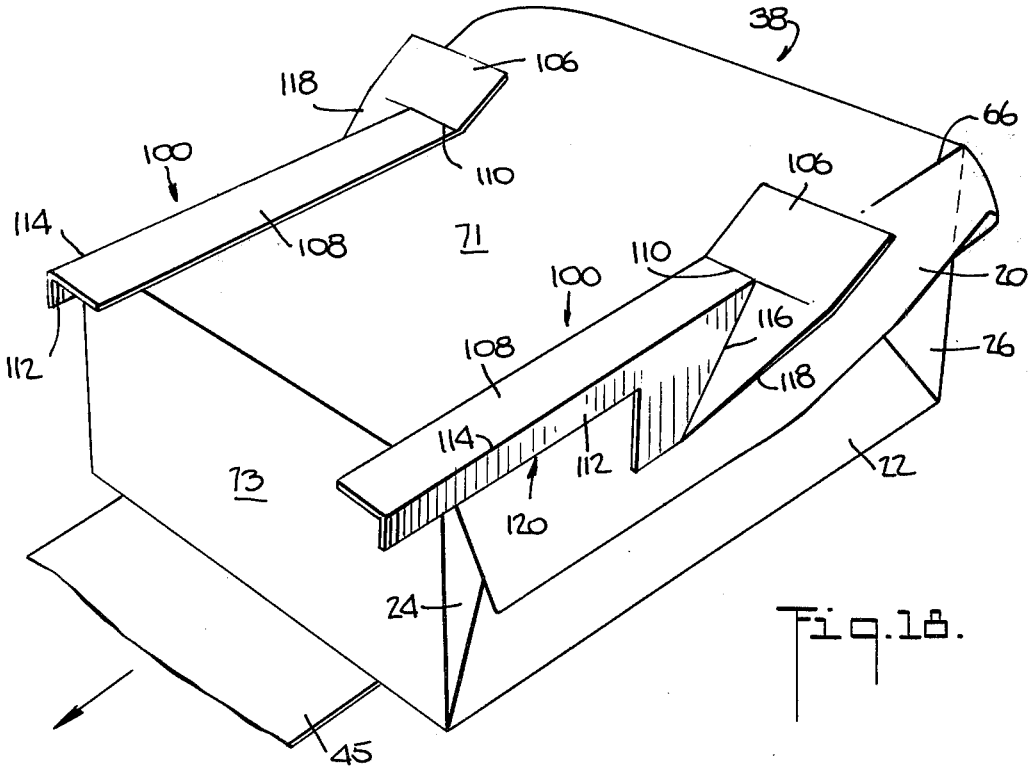
FIG. 18 is an enlarged perspective view showing further details of the upper flap folding shoe.

FIGS. 17 and 18 show details of the new and improved upper flap forming shoe 100, which comprises a relatively wide downwardly-forwardly angled inlet portion 106, that connects with a relatively narrow horizontal upper portion 108, along line 110. The upper edge of a vertically disposed sidewall portion 112 is connected to the outer edge of the upper portion 108 along line 114. The inlet portion 106 is connected to the sidewall portion 112 along a downwardly-forwardly directed line 116. The trailing portion of the outer edge 118 of the inlet portion 106 is angled downwardly and inwardly. The sidewall portion 112 has a recess or cut out portion adjacent its trailing end, as indicated at 120, FIG. 18.

Figure 14:
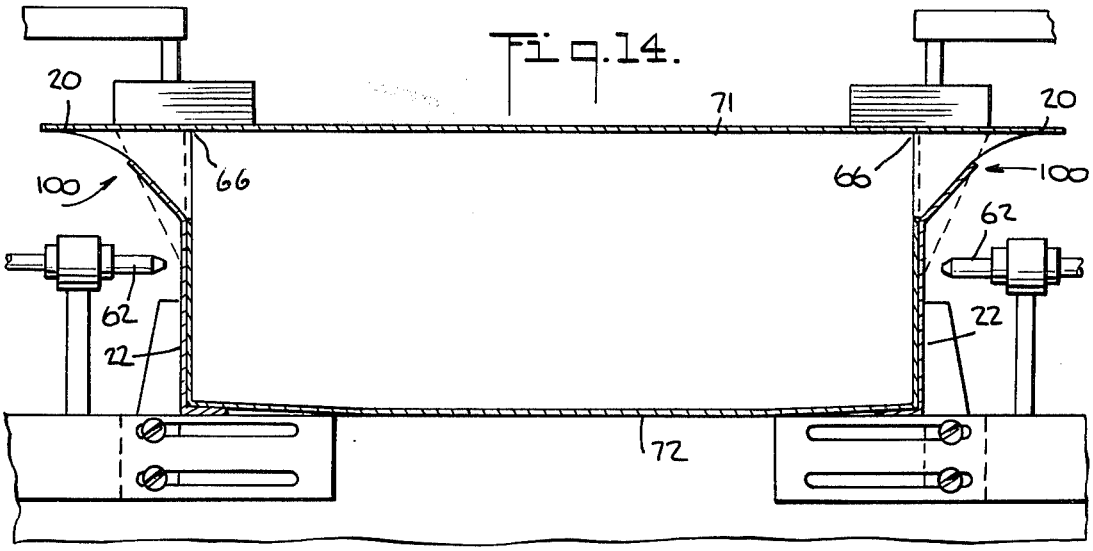
FIGS. 14, 15 and 16 are transverse cross sectional views taken along the lines indicated at 14—14, 15—15, and 16—16 of FIG. 12, respectively, showing the sequential steps in the formation of the upper flaps.
Figure 15:
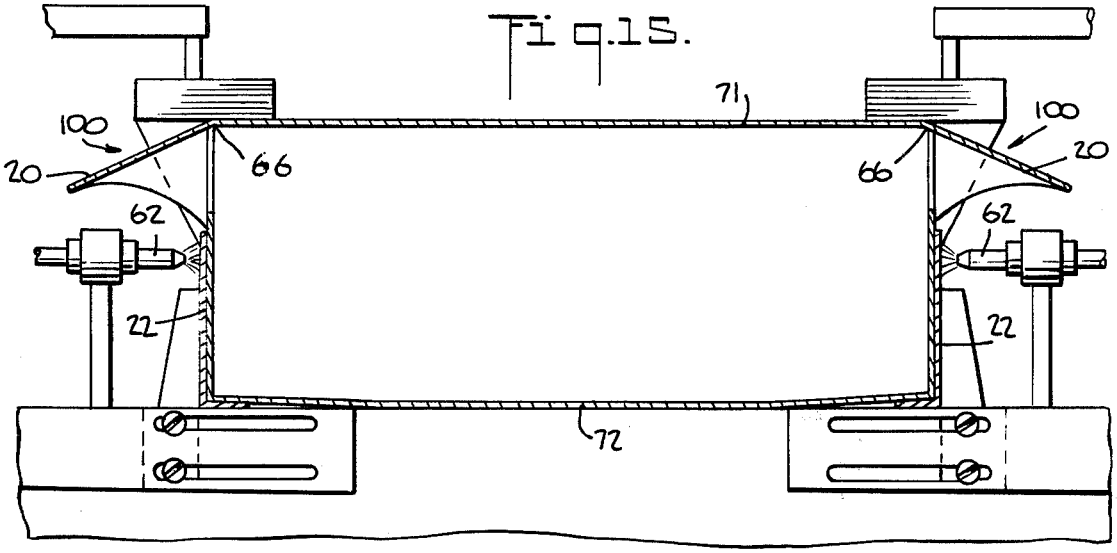
Figure 16:
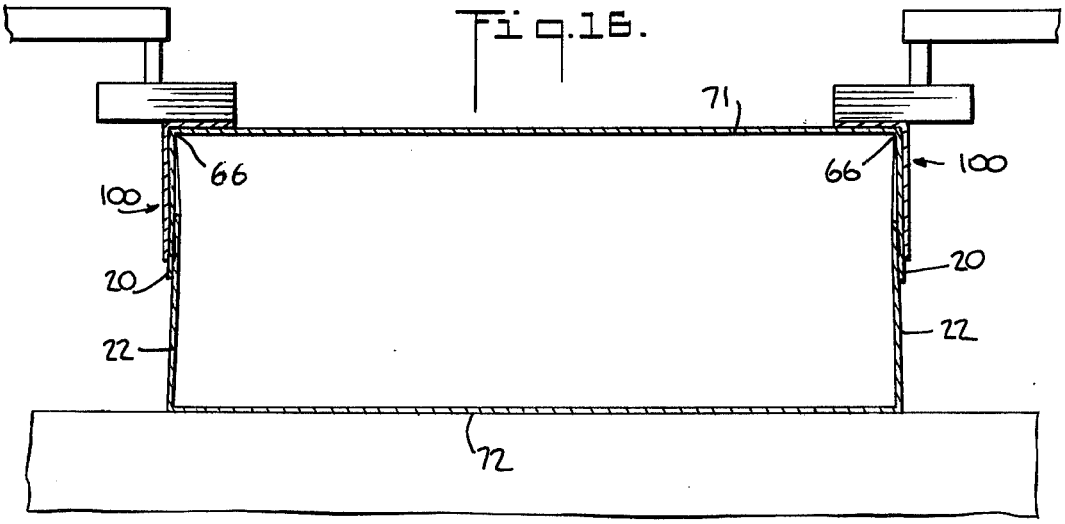

In operation, the upper flap forming shoe 100 serves to gradually fold the upper flap 20 downwardly about its fold line 66, as well as completing the folding operation of the side flaps 24 and 26, as indicated sequentially in FIGS. 14, 15 and 16. It is noted that the aforementioned adhesive application is effected subsequent to the completion of the folding of the bottom flap 22 and during the initial phase of the folding of the upper flap 20, as indicated in FIG. 15. The trailing portions of the upper flap forming shoe 100 serve to press the upper flap against the adhesive strip 32 on the bottom flap 22 and thereby seal the bundle. Thence, the completed bundle is discharged from the conveyor 45 at the left-hand end of the machine, as viewed in FIG. 12.

It will thus be seen that the present invention does indeed provide an improved method and apparatus for forming end closures for bundles of articles wrapped in a tubular wrapper, which is superior in simplicity, reliability and efficiency, as compared to prior art such devices.

Although a certain particular embodiment of the invention is herein disclosed for purposes of explanation, various modifications thereof, after study of the specification, will be apparent to those skilled in the art to which the invention pertains.

What is claimed and desired to be secured by letters patent is:

1. In a machine for forming bundles of articles wrapped in a tubular wrapper including a first panel having a first flap at each end thereof, an opposed second panel having a second flap at each end thereof, and a pair of opposed third panels interposed between said first and second panels respectively, each of said third panels having third flaps at the ends thereof, the combination comprising:

an elongated substantially flat conveyor having a longitudinal line of movement for carrying said bundle through a series of bundle wrapping stations;

a first stationary station disposed adjacent the inlet end of said conveyor for receiving a turbular wrapper with said flaps extending substantially straight outwardly and transversely with respect to said longitudinal line of movement of the conveyor and for forming an end closure at each end of the bundle, four pairs of spaced folding wings disposed in said first station, each of said pairs being movable between an open position and a closed position to each form a corner fold line between said second flap and the adjacent third flap respectively, the folding wings of each pair being hingedly connected together by hinge means, means mounting said folding wings so that in their open position they are substantially parallel to the third panels in a first plane extending transversely of said longitudinal line of movement of the conveyor and in their closed position they are substantially parallel to the second panel in a second plane normal to the first plane extending transversely of the longitudinal line of movement of the conveyor, the folding wings of each pair also partially folding each of said third flaps inwardly with respect to said conveyor when moving from their open position to their closed position;

a second station, said conveyor serving to carry a bundle from said first station to said second station, means adjacent each side of the conveyor in said second station for folding said second flaps inwardly with respect to said conveyor to partially cover said third flaps respectively;

a third station, said conveyor serving to carry a bundle from said second station to said third station, means adjacent each side of the conveyor in said third station for applying a line of adhesive extending across said second flap and partially across each of said third flaps;

a fourth station, said conveyor serving to carry a bundle from said third station to said fourth station, means adjacent each side of the conveyor in said fourth station for completing the inward folding with respect to the conveyor of said third flaps and for folding said first flap inwardly with respect to the conveyor to engage said line of adhesive to seal the bundle.

2. A machine according to claim 1, wherein the width of each folding wing in said first station adjacent the end of said bundle is preselected so that the length of the end edge of the second flap is substantially less than the length of the end edge of the first flap.

3. A machine according to claim 2, wherein the length of each folding wing in said first station adjacent the end of said bundle is substantially equal to the length of said flaps.

4. A machine according to claim 3, wherein the dimensions of the other folding wing of each pair of said folding wings respectively, are substantially the same as the dimensions of said folding wings adjacent the end of said bundle, except that an outer corner thereof is recessed.

5. A machine according to claim 1, wherein said conveyor is substantially horizontally disposed and wherein said means adjacent each side of the conveyor in said fourth station for completing the inward folding with respect to the conveyor of said third flaps and for folding said first flap inwardly with respect to the conveyor to engage said line of adhesive to seal on each side of said conveyor the bundle comprises a first flap forming shoe disposed above said conveyor, each of said forming shoes having a downwardly with respect to the conveyor and forwardly in the direction of movement of the conveyor angled inlet portion, a horizontal portion and a vertically disposed sidewall portion.

6. A machine according to claim 5, wherein said inlet portion is plate-like and is wider than said horizontal portion, and wherein said inlet portion is connected to said vertical portion along a downwardly-forwardly directed line.

* * * * *